US006304181B1

(12) United States Patent
Matsudaira

(10) Patent No.: US 6,304,181 B1
(45) Date of Patent: Oct. 16, 2001

(54) ANTITHEFT SYSTEM AND MONITORING SYSTEM

(75) Inventor: Shinji Matsudaira, Daito (JP)

(73) Assignee: Sanyo Electronics Co., LTD, Osaka (JP)

( * ) Notice: Subject to any disclaimer, the term of this patent is extended or adjusted under 35 U.S.C. 154(b) by 0 days.

(21) Appl. No.: 09/419,909

(22) Filed: Oct. 18, 1999

(30) Foreign Application Priority Data

Oct. 20, 1998 (JP) ..... 10-298447
Jan. 18, 1999 (JP) ..... 11-009439

(51) Int. Cl.[7] ..... G08B 13/14

(52) U.S. Cl. ..... 340/571; 340/572.1; 340/572.4; 340/572.7

(58) Field of Search ..... 340/571, 568.1, 340/568.2, 572.1, 572.4, 572.8, 825.36, 825.49

(56) References Cited

U.S. PATENT DOCUMENTS 3,493,955 * 2/1970 Minasy ..... 340/572.7
5,245,317 * 9/1993 Chidley et al. ..... 340/571
5,327,118 * 7/1994 Drucker et al. ..... 340/572.1
5,353,011 * 10/1994 Wheeler et al. ..... 340/572.1
5,477,219 * 12/1995 Zarembo et al. ..... 340/572.1
5,760,681 * 6/1998 Varis et al. ..... 340/432
5,801,631 * 9/1998 Hayashi ..... 340/572.1
5,808,548 * 9/1998 Sasagawa et al. ..... 340/571
5,912,622 * 6/1999 Endo et al. ..... 340/572.5
5,973,597 * 10/1999 Hayashi ..... 340/572.1
5,982,283 * 11/1999 Matsudaira et al. ..... 340/572.3
5,995,005 * 11/1999 Hayashi ..... 340/572.4
6,018,298 * 1/2000 Endo et al. ..... 340/572.5
6,043,744 * 3/2000 Matsudaira ..... 340/571
6,118,367 * 9/2000 Ishii ..... 340/10.1

FOREIGN PATENT DOCUMENTS 8-279082 10/1996 (JP) .

* cited by examiner

*Primary Examiner*—Daniel J. Wu
*Assistant Examiner*—Toan Pham
(74) *Attorney, Agent, or Firm*—Arent Fox Kintner Plotkin & Kahn, PLLC

(57) ABSTRACT

This invention provides an antitheft system comprising an antitheft gate 2 installed in the vicinity of an exit of a store, and an alarm unit 1 attached to a commodity. The gate 2 has incorporated therein a signal generator 21 for producing a notifying signal, and an alarm device 22 capable of producing an alarm. The alarm unit 1 comprises an electronic buzzer 11, a receiving antenna 15 for receiving the notifying signal from the signal generator 21 of the gate 2, and a control circuit 17 for operating the buzzer 11 upon the antenna 15 receiving the notifying signal. The alarm device 22 of the gate 2 comprises an alarm producing circuit 225 capable of producing an alarm, a receiving antenna 221 for receiving electromagnetic waves generated by the buzzer 11 by operating the buzzer 11, and a control circuit 224 for operating the alarm producing circuit 225 upon the antenna 221 receiving the electromagnetic waves. The construction described renders the alarm unit 1 compact.

11 Claims, 6 Drawing Sheets

ANTITHEFT SYSTEM AND MONITORING SYSTEM

FIELD OF THE INVENTION

The present invention relates to antitheft systems for protecting merchandise on display in stores against unlawful acts such as shoplifting, and more particularly to an antitheft system which comprises an alarm unit attached to the commodity or like article to be prevented from being stolen for giving an alarm in the event of the unlawful act and an alarm device incorporated, for example, in an antitheft gate for producing an alarm upon the alarm unit giving the alarm.

BACKGROUND OF THE INVENTION

FIG. 8 shows an antitheft system conventionally used in stores wherein commodities such as compact disk cassettes and magnetic tape cassettes are on display for sale, to protect these articles against shoplifting or like illegal acts.

The antitheft system comprises an antitheft gate 5 installed in the vicinity of an exit 8 of the store, and an alarm unit 4 attached to a commodity 7. The antitheft gate 5 has incorporated therein a circuit board 50 and a transmitting antenna (not shown). The circuit board 50 is provided with a transmitting circuit (not shown) for producing a notifying signal for the alarm unit 4.

With reference to FIG. 9, the alarm unit 4 comprises an electronic buzzer 41, circuit board 42, battery (not shown), etc. which are housed in a casing 40. The casing 40 has a surface formed with sound emitting holes 43 and an alarm actuating switch piece 44. The electronic buzzer 41 has its operation controlled by the circuit board 42 and is adapted to produce an alarm when the unit 4 is removed from the commodity 7 or when the unit 4 passes by the antitheft gate 5.

The commodity is placed on display in the store, with the alarm unit 4 attached thereto. When selling the commodity 7 to the customer, the clerk holds the buzzer 41 out of operation by sending a specified signal from a nullifying device (not shown) to the circuit board 42 of the alarm unit 4, then removes the unit 4 from the commodity 7 and hands the commodity to the customer in exchange for money.

If the customer wrongfully removes the alarm unit 4 from the commodity 7, the switch piece 44 is turned off to cause the buzzer 41 to produce a sound. Further if the customer acts to unlawfully bring the commodity 7 out of the store along with the alarm unit 4, the circuit board 42 of the alarm unit 4 receives a notifying signal from the transmitting antenna of the antitheft gate 5 to turn on the buzzer 41.

However, the antitheft system described has the problem of failing to prevent the theft of commodities reliably since the alarm is emitted only by the alarm unit 4.

Accordingly, the present applicant has already filed an application for patent on an antitheft system which is adapted to produce an alarm not only from an alarm unit but also from an antitheft gate in the event of an unlawful act so as to give improved reliability to the antitheft system (JP-A No. 279082/1996).

The antitheft gate for the antitheft system has a signal generator for producing a notifying signal for the alarm unit, and an alarm device capable of producing an alarm.

With reference to FIG. 10, the alarm unit 6 includes a receiving antenna 61 which comprises a coil L1 and a capacitor C3 connected in parallel therewith. The antenna 61 receives a signal, which is then fed to an incoming signal amplification circuit 62 for amplification and thereafter to a control circuit 63. When the signal from the amplification circuit 62 is a notifying signal from the antitheft gate, the control circuit 63 gives a drive command to an electronic buzzer 64, which in turn produces a sound in response to the command.

When the notifying signal is received from the gate via the amplification circuit 62, the control circuit 63 also delivers a signal preparation command to a signal processing circuit 65, which in turn prepares a second notifying signal. The second notifying signal is amplified in an outgoing signal amplification circuit 66, then fed to a transmitting antenna 67 comprising a coil L2 and a capacitor C4 connected in series therewith and sent out.

The alarm device in the antitheft gate produces an alarm on receiving the second notifying signal from the alarm unit 6.

The antitheft system described is so adapted that when the customer is about to wrongfully bring out the commodity from the store along with the alarm unit 6, an alarm is given not only by the unit 6 but also by the antitheft gate. In this way, an improvement is made for more reliable prevention of theft of commodities.

However, the alarm unit 6 of the antitheft system, which has the receiving antenna 61, circuits 62, 63 and electronic buzzer 64 for giving an alarm in response to the notifying signal from the antitheft gate, further comprises the circuits 65, 66 for preparing and processing the second notifying signal and the transmitting antenna 67 and therefore has the problem that the alarm unit 6 is large-sized and difficult to attach to small commodities.

SUMMARY OF THE INVENTION

An object of the present invention is to provide an antitheft system adapted to prevent the theft of commodities, etc. with high reliability and comprising an alarm unit which is easy to attach to small commodities.

Directing attention to the fact that the electronic buzzer 64 incorporated in the conventional alarm unit 6 shown in FIG. 10 generates electromagnetic waves when driven, we conceived the idea of utilizing the electromagnetic waves generated by the electronic buzzer 64 to dispense with the circuits 65, 66 for preparing or processing the second notifying signal and the transmitting antenna 67. Thus, we have completed a first antitheft system according to the present invention.

The present invention provides a first antitheft system which comprises:

- a notifying signal generator for producing a notifying signal,
- an alarm unit to be attached to an article to be prevented from being stolen and comprising an electronic buzzer, signal receiving means for receiving the notifying signal from the notifying signal generator, and first control means for operating the electronic buzzer upon the signal receiving means receiving the notifying signal, and
- an alarm device comprising alarm means capable of producing an alarm, electromagnetic wave receiving means for receiving electromagnetic waves generated by the electronic buzzer by operating the electronic buzzer, and second control means for operating the alarm means upon the electromagnetic wave receiving means receiving the electromagnetic waves.

When the first antitheft system is installed, for example, in a store for selling commodities, the notifying signal generator is disposed in the vicinity of an exit of the store, and the commodity to be protected against theft is on display as connected to the alarm unit. The alarm device is housed in a casing along with the notifying signal generator, or singly in a casing separate from a casing for the notifying signal generator, and the casing or casings are provided in the store.

If the customer is about to wrongfully bring out the commodity from the store, the signal receiving means of the alarm unit receives a notifying signal from the signal generator, whereupon the first control means operates the electronic buzzer, causing the buzzer to produce a sound.

The operation of the buzzer generates electromagnetic waves therefrom which are received by the electromagnetic wave receiving means of the alarm device, whereupon the second control means operates the alarm means, causing the alarm means to produce a sound.

When the customer is about to unlawfully bring out the commodity from the store which is equipped with the first antitheft system of the invention, an alarm is given not only by the alarm unit but also by the alarm device, whereby the theft of the commodity can be prevented with higher reliability than by the conventional antitheft system which produces an alarm only from its alarm unit.

Since the electromagnetic waves generated by the electronic buzzer of the alarm unit when the buzzer is in operation are utilized as a signal for driving the alarm means of the alarm device, the alarm unit need not be provided with the circuits for preparing and processing the signal for driving the alarm means of the alarm device and the antenna for transmitting the signal. Thus, these circuits can be dispensed with, whereby the alarm unit can be compacted and is made easy to attach to a small commodity.

We have further conducted intensive research in order to provide a compacted alarm unit and consequently found that the coil L1 constituting the receiving antenna 61 shown in FIG. 10 and the coil L2 constituting the transmitting antenna 67 shown in the same drawing are great factors for making the alarm unit large-sized. Based on this finding we have completed the second antitheft system of the invention.

The present invention provides a second antitheft system which comprises:

a notifying signal generator for producing a first notifying signal, an alarm unit to be attached to an article to be prevented from being stolen and operable to produce an alarm and a second notifying signal different from the first notifying signal in frequency upon receiving the first notifying signal from the signal generator, and an alarm device for producing an alarm upon receiving the second notifying signal from the alarm unit, the alarm unit having an antenna for receiving the first notifying signal and transmitting the second notifying signal, the antenna comprising a coil usable in common for receiving the first notifying signal and for transmitting the second notifying signal.

When the second antitheft system is installed, for example, in a store for selling commodities, the notifying signal generator is disposed in the vicinity of an exit of the store, and the commodity to be protected against theft is on display as connected to the alarm unit. The alarm device is housed in a casing along with the notifying signal generator, or singly in a casing separate from a casing for the notifying signal generator, and the casing or casings are provided in the store.

If the customer is about to wrongfully bring out the commodity from the store, the antenna of the alarm unit receives a first notifying signal from the signal generator, whereupon the alarm unit produces an alarm, and the antenna transmits a second notifying signal which is different from the first notifying signal in frequency.

The alarm device produces an alarm in response to the second notifying signal.

When the customer is about to wrongfully bring out the commodity from the store which is equipped with the second antitheft system of the invention, an alarm is given not only by the alarm unit but also by the alarm device, whereby the theft of the commodity can be prevented with higher reliability than by the conventional antitheft system which produces an alarm only from its alarm unit.

The alarm unit has a single coil only which serves in common for receiving the first notifying signal and transmitting the second notifying signal, so that the alarm unit is more compact than the conventional alarm unit which has separate two coils, i.e., the coil L1 for receiving the first notifying signal and the coil L2 for transmitting the second notifying signal, and is easier to attach to a small commodity.

BRIEF DESCRIPTION OF THE DRAWINGS

FIG. 4(*b*) is a waveform diagram showing a switching signal produced from a switching signal generating circuit of the antitheft gate;

FIG. 4(*c*) is a waveform diagram showing a notifying signal transmitted from the antitheft gate to the alarm unit;

DETAILED DESCRIPTION OF EMBODIMENTS

Two embodiments of the present invention will be described below in detail.

First Embodiment

Figure 1:
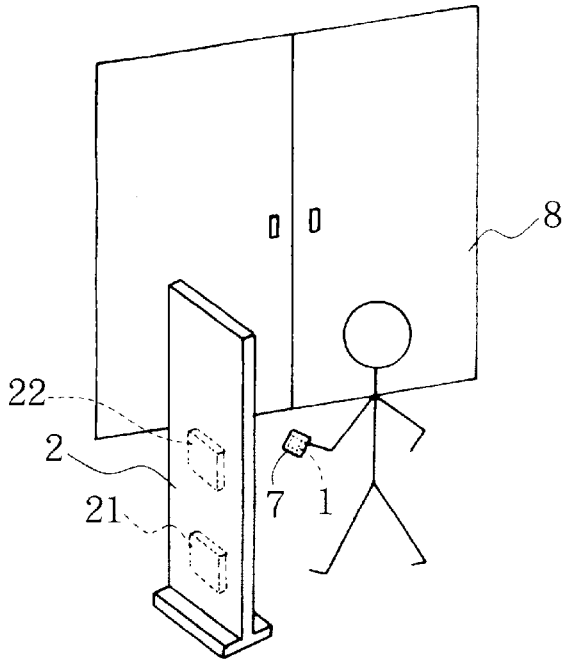
FIG. 1 is a perspective view showing an antitheft gate of the invention installed in the vicinity of an exit of a store.

With reference to FIG. 1, the antitheft system of this embodiment comprises an antitheft gate 2 installed in the vicinity of an exit 8 of a store, and an alarm unit 1 attached to a commodity 7. The gate 2 has incorporated therein a signal generator 21 for producing a notifying signal for the alarm unit 1, and an alarm device 22 adapted to produce an alarm.

Figure 2:
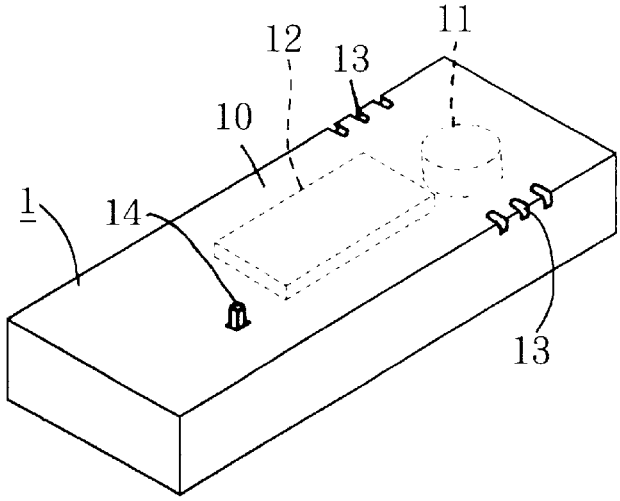
FIG. 2 is a perspective view of alarm unit of a first embodiment.

As shown in FIG. 2, the alarm unit 1 comprises an electronic buzzer 11 enclosed in a casing 10 for producing an alarm. The buzzer 11 can be driven with a current having a rectangular waveform 2.7 kHz in frequency and 25 to 35% in duty. Connected to the electronic buzzer 11 is a circuit board 12 for controlling the operation of the buzzer 11. The casing 10 has a surface formed with sound emitting holes 13 and an alarm actuating switch piece 14. The switch piece 14 serves to hold the buzzer 11 in a standby state for buzzing when in an on state as pressed in the casing 10 or to cause the buzzer 11 to produce a sound when projecting from the casing 10 in an off state.

Figure 3:
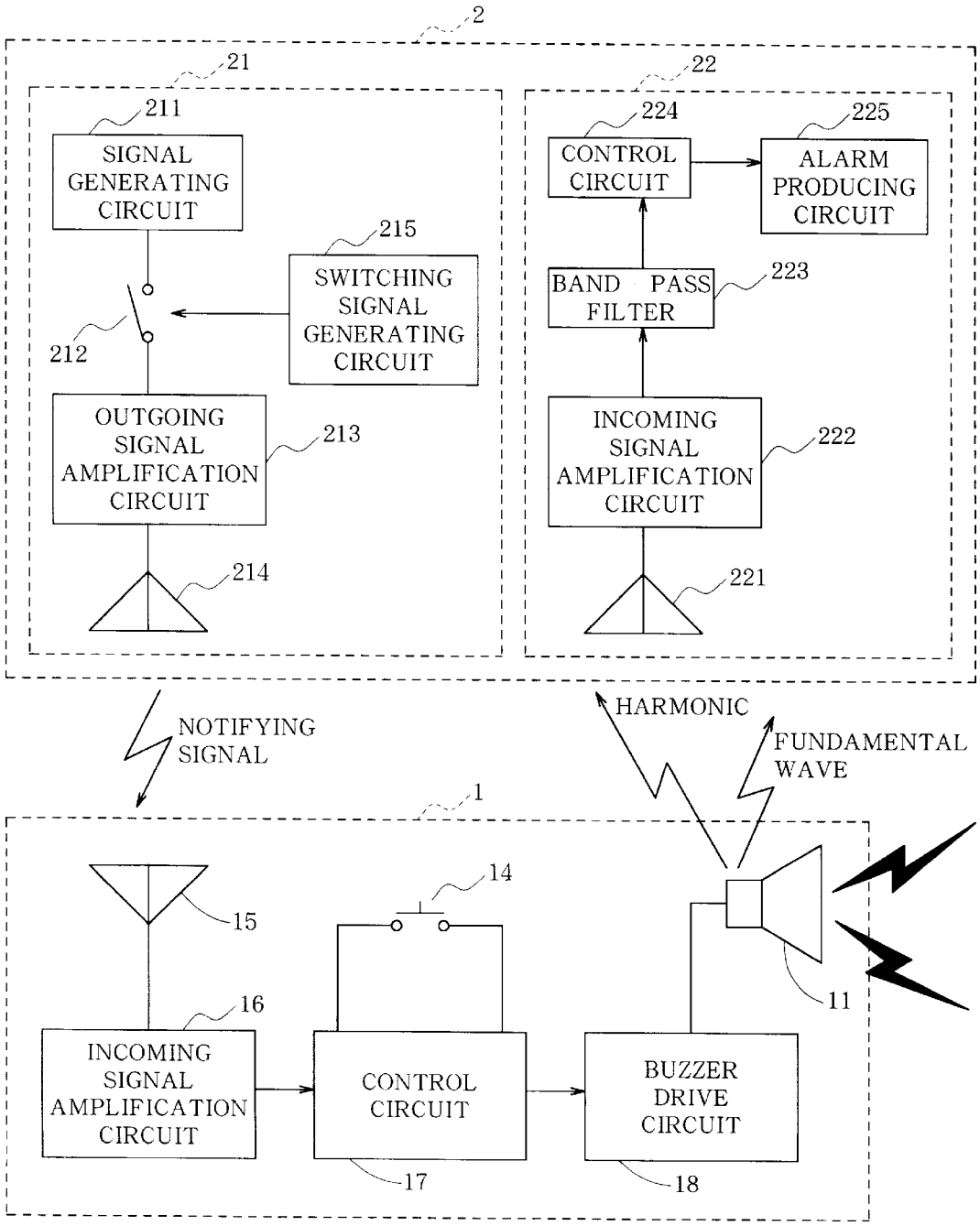
FIG. 3 is a block diagram showing the circuit construction of antitheft system of the first embodiment.

FIG. 3 shows the circuit construction of antitheft system of the present embodiment.

The alarm unit 1 of the present embodiment has the same circuit construction as the conventional alarm unit 4 which operates only for producing an alarm in response to a notifying signal from an antitheft gate. The unit 1 has a receiving antenna 15 connected to a control circuit 17 by way of an incoming signal amplification circuit 16.

The receiving antenna 15 receives the notifying signal to be described later and feeds the signal to the amplification circuit 16. The notifying signal is amplified by the circuit 16 and then fed to the control circuit 17.

The control circuit 17 has connected thereto the switch piece 14 and a buzzer drive circuit 18, to which the electronic buzzer 11 is connected.

The control circuit 17 recognizes the closed state of the alarm actuating switch piece 14 as the on state while recognizing the open state of the switch piece 14 as the off state. When recognizing that the switch piece 14 is off, the control circuit 17 prepares a control signal for operating the electronic buzzer 11.

The control circuit 17 also checks whether the signal from the incoming signal amplification circuit 16 is the notifying signal from the gate 2. When the notifying signal is identified, the circuit 17 prepares a control signal for operating the buzzer 11.

Figure 5:
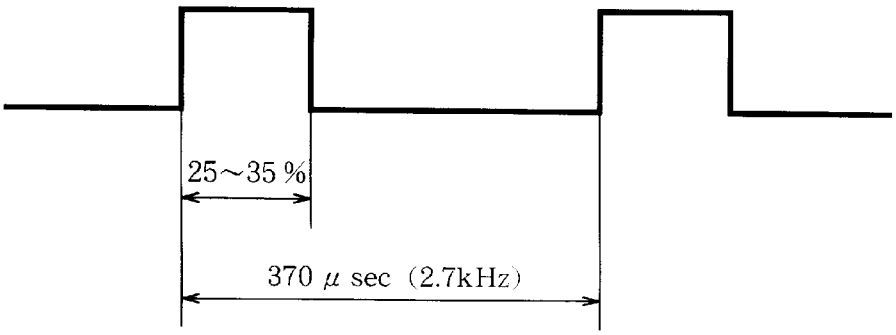
FIG. 5 is a waveform diagram showing a drive current for driving an electronic buzzer of the alarm unit.

The control signal thus prepared by the control circuit 17 is fed to the buzzer drive circuit 18, which in turn supplies a drive current to the buzzer 11. As shown in FIG. 5, the drive current has a rectangular waveform which is 2.7 kHz in frequency and 25 to 35% in duty. The current supplied causes the buzzer 11 to produce a sound.

While the buzzer 11 is producing the sound, electromagnetic waves are emitted by the buzzer 11. The electromagnetic waves comprise a fundamental wave having the same frequency as the drive current, i.e., 2.7 kHz, and an nth harmonic having n times the frequency (n is an integer of at least 2).

On the other hand, the signal generator 21 incorporated in the antitheft gate 2 of the present embodiment comprises a signal generating circuit 211, to which a transmitting antenna 214 is connected via a switch 212 and an outgoing signal amplification circuit 213. Connected to the switch 212 is a switching signal generating circuit 215 for producing a switching signal for on-off controlling the switch 212.

Figure 4A:
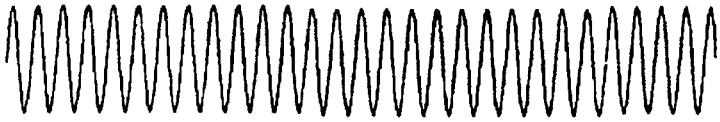
FIG. 4(*a*) is a waveform diagram showing an original notifying signal produced from a signal generating circuit of the antitheft gate.
Figure 4B:
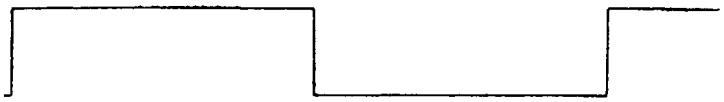
Figure 4C:
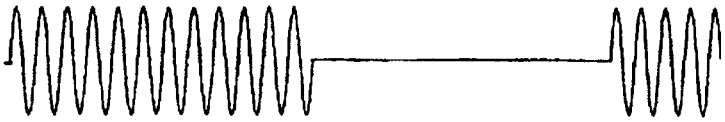

The signal generating circuit 211 produces an original notifying signal having a sinusoidal waveform as shown in FIG. 4(*a*). The switch 212 is turned on and off with the switching signal shown in FIG. 4(*b*) and produced by the switching signal generating circuit 215, whereby the original notifying signal is made into a notifying signal comprising burst waves of predetermined pattern as shown in FIG. 4(*c*). The notifying signal thus produced is 37.5 kHz in frequency.

The notifying signal is fed to the amplification circuit 213 for amplification, then fed to the transmitting antenna 214 and sent out as converted to electromagnetic waves.

The alarm device 22 incorporated in the antitheft gate 2 has a receiving antenna 221, which is connected to a control circuit 224 via an incoming signal amplification circuit 222 and a band-pass filter 223. The filter 223 permits the passage of a signal with a frequency of 5.4 kHz. Connected to the control circuit 224 is an alarm producing circuit 225 for producing a sound or light alarm.

While buzzing, the electronic buzzer 11 of the alarm unit 1 produces an electromagnetic wave signal as already described. The receiving antenna 221 receives the wave signal and converts the signal to a signal of a.c. current. The a.c. current signal is fed to the amplification circuit 222 for amplification and thereafter fed to the band-bass filter 223. Of the signals input to the filter 223, only the signal with a frequency of 5.4 kHz which is obtained by converting the second harmonic of electromagnetic waves generated by the alarm unit 1 to a.c. current is passed through the filter 223. The signal passing through the filter 223 is fed to the control circuit 224.

In response to the signal, the control circuit 224 gives an alarm production command to the alarm producing circuit 225, which in turn produces an alarm.

When the customer wrongfully removes the alarm unit 1 of antitheft system of the present embodiment from the commodity, the alarm actuating switch piece 14 opens, and the control circuit 17 recognizes this state as the off state, consequently causing the buzzer 11 to produce a sound.

Further when the customer is about to unlawfully bring out the alarm unit 1 from the store along with the commodity, the receiving antenna 15 of the alarm unit 1 receives a notifying signal from the transmitting antenna 214 of the signal generator 21 incorporated in the antitheft gate 2, and the notifying signal is fed to the control circuit 17 via the amplification circuit 16. As a result, the electronic buzzer 11 produces a sound.

Upon buzzing of the buzzer 11, the receiving antenna 221 of the alarm device 22 incorporated in the gate 2 receives an electromagnetic wave signal emitted by the buzzer 11, converting the signal to an a.c. current signal. This signal is fed via the amplification circuit 222 to the band-pass filter 223, which in turn feeds a signal with a frequency of 5.4 kHz to the control circuit 224. As a result, the alarm producing circuit 225 gives an alarm.

The antitheft system of the present embodiment produces an alarm from the alarm unit 1 and the antitheft gate 2 in the event of the customer acting wrongfully as stated above, whereby the theft of the commodity can be prevented with higher reliability than by the conventional antitheft system which produces an alarm only from its alarm unit 4.

Furthermore, the alarm unit 1 of the present embodiment is compacted and made easy to attach to small commodities by eliminating the signal preparing and processing circuits and transmitting antenna for causing the alarm device 22 incorporated in the gate 2 to give an alarm.

The signal for driving the alarm producing circuit 225 of the alarm device 22 in the antitheft gate 2, i.e., the second harmonic of electromagnetic waves generated by the electronic buzzer 11 of the alarm unit 1, is wider in the range of transmission than the fundamental wave and has a relatively great output among the harmonics constituting the electromagnetic waves. Accordingly, the second harmonic of electromagnetic waves generated by the buzzer 11 can be reliably received in the wider range by the alarm device 22 of the gate 2, enabling the alarm device 22 to reliably give an alarm in the event of the customer acting unlawfully. Consequently, the commodities and the like can be protected against theft with further improved reliability.

Second Embodiment

The antitheft system of this embodiment comprises an antitheft gate having the same construction as the conventional one and capable of producing an alarm, the alarm unit 3 to be described below, and an alarm stopping device for discontinuing the alarm of the alarm unit 3.

The antitheft gate comprises a signal generator for producing a first notifying signal for causing the alarm unit 3 to produce an alarm, and an alarm device for producing an alarm upon receiving from the alarm unit 3 the second notifying signal to be described below. The alarm device produces the alarm only while receiving the second notifying signal. The first notifying signal has a frequency of 37.5 kHz.

The alarm stopping device comprises a signal generating circuit for producing an alarm stop signal for discontinuing the alarm of the alarm unit 3. The alarm stop signal has the same frequency as the first notifying signal, i.e., 37.5 kHz, and has a signal pattern different from that of the first notifying signal.

Figure 6:
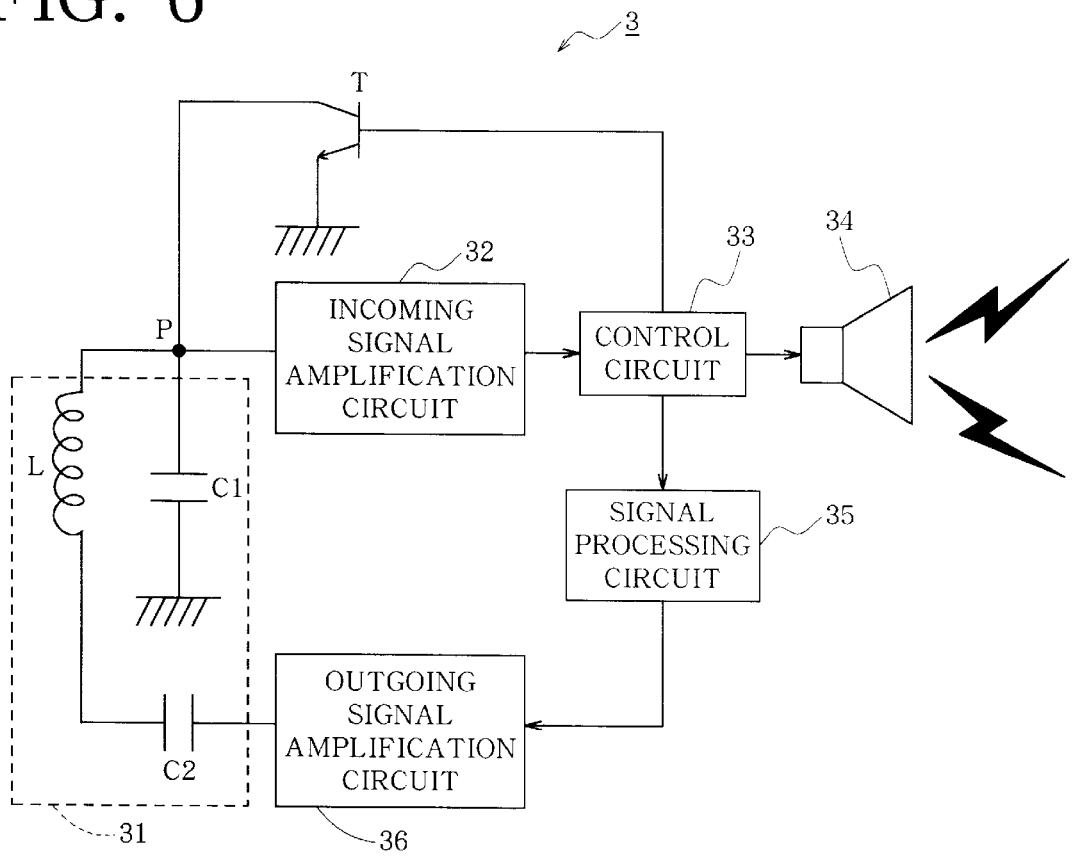
FIG. 6 is a block diagram showing the circuit construction of alarm unit of a second embodiment.

FIG. 6 shows the circuit construction of the alarm unit 3 of the present embodiment.

As illustrated, the alarm unit 3 has an antenna 31, which is connected to a control circuit 33 via an incoming signal amplification circuit 32.

The antenna 31 is connected to the control circuit 33 also by way of a transistor T, which is on-off controlled by an on-off control signal from the control circuit 33. As will be described below, the antenna 31 is brought into a receiving operation or alternatively into a transmitting operation by turning on or off the transistor T.

The control circuit 33 has connected thereto a buzzer 34 and a signal processing circuit 35, which is connected to the antenna 31 via an outgoing signal amplification circuit 36.

The antenna 31 of the present invention comprises a coil L and two capacitors, i.e., a first capacitor C1 and a second capacitor C2. The second capacitor C2 is sufficiently greater than the first capacitor C1 in capacity.

The coil L has one end P having connected thereto one end of the first capacitor C1 and the input end of the incoming signal amplification circuit 32. The other end of the first capacitor C1 is grounded. The collector of the transistor T is connected to the end P of the coil L, and the control circuit 33 is connected to the base of the transistor T.

The second capacitor C2 has one end connected to the other end of the coil L and the other end connected to the output end of the outgoing signal amplification circuit 36.

When the transistor T is in conduction, the end P of the coil L is grounded, rendering the first capacitor no longer operable as such and causing an LC circuit comprising the coil L and second capacitor C2 to serve the transmitting function. In this way, the antenna 31 performs the transmitting operation by the coil L and the second capacitor C2.

When the transistor T is out of conduction, on the other hand, the other end of the coil L is in a state equivalent to a grounded state, rendering the second capacitor C2 no longer serviceable as such because the second capacitor C2 has a sufficiently greater capacity than the first capacitor C1, with the result that an LC circuit composed of the coil L and first capacitor C1 serves the receiving function. In this way, the antenna 31 performs the receiving operation by the coil L and the first capacitor C1.

While the antenna 31 is in the receiving operation with the transistor T out of conduction, the antenna receives a first notifying signal from the antitheft gate and an alarm stop signal from the alarm stopping device. These signals are applied to the incoming signal amplification circuit 32 for amplification and thereafter fed to the control circuit 33.

The control circuit 33 checks whether the signal input from the amplification circuit 32 is the first notifying signal or the alarm stop signal from the alarm stopping device.

When the input signal from the circuit 32 is found to be the first notifying signal, the control circuit 33 gives an alarm start command to the buzzer 34, which in turn starts to produce an alarm.

Figure 7:
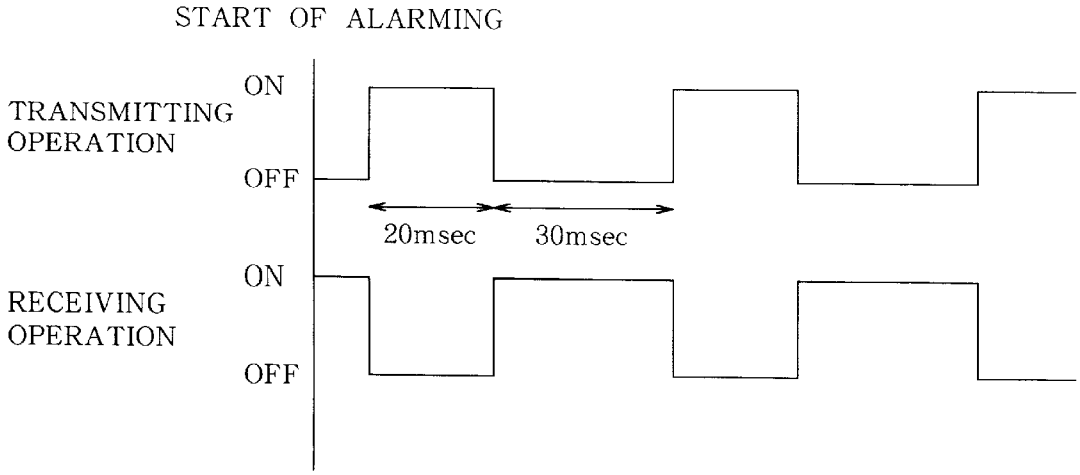
FIG. 7 is a timing chart showing the timing at which an antenna of the alarm unit is changed over from a transmitting operation to a receiving operation and vice versa.
Figure 8:
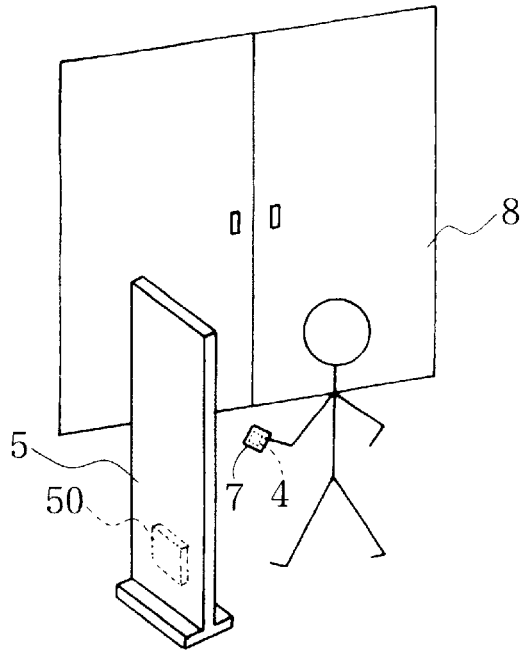
FIG. 8 PRIOR ART
FIG. 8 is a perspective view showing a conventional antitheft gate installed in the vicinity of an exit of a store.
Figure 9:
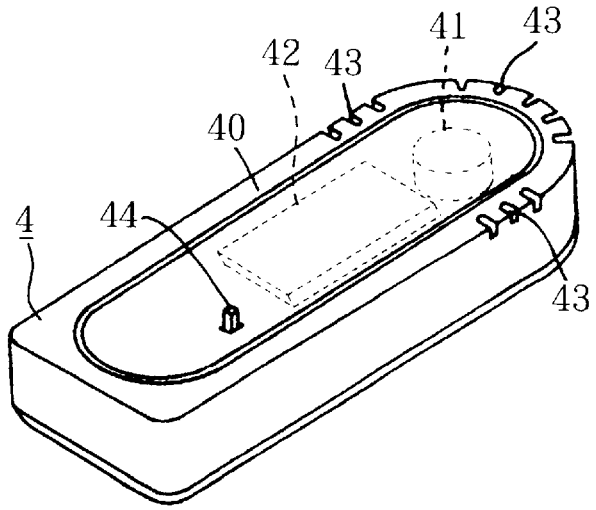
FIG. 9 PRIOR ART
FIG. 9 is a perspective view showing a conventional alarm unit.
Figure 10:
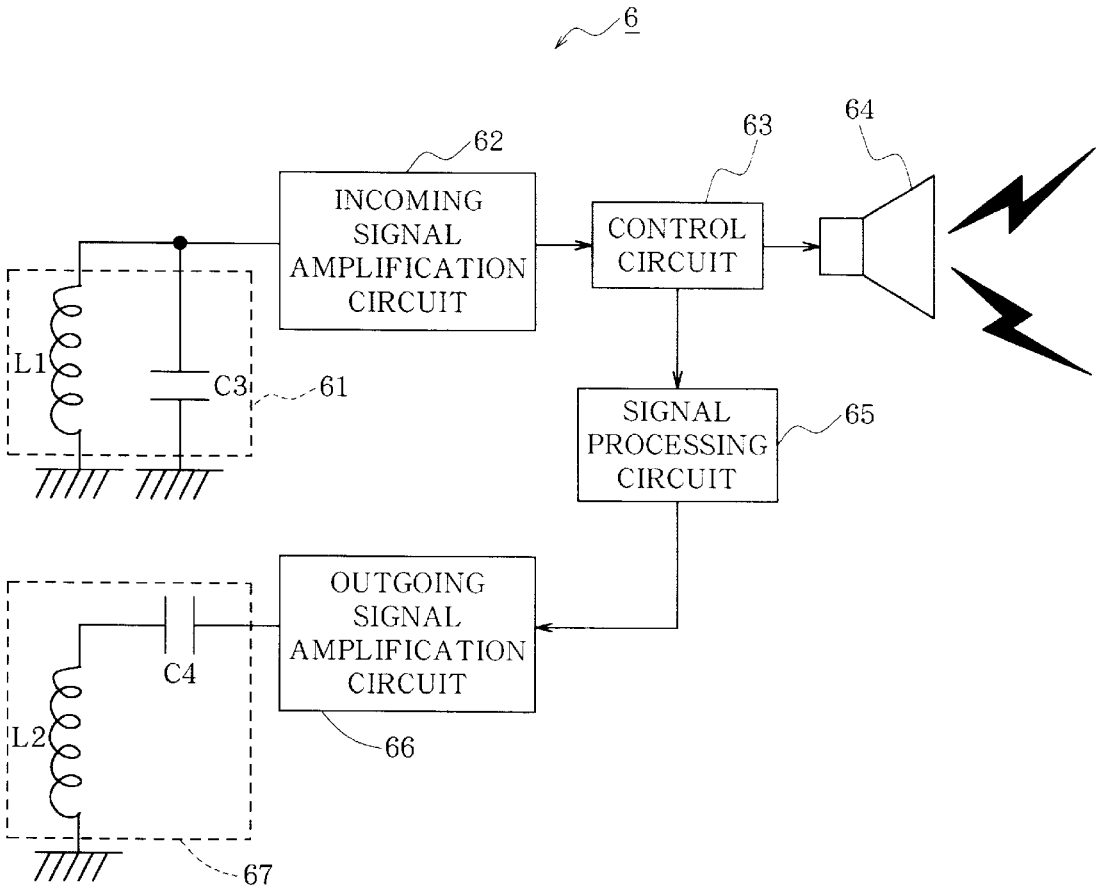
FIG. 10 PRIOR ART
FIG. 10 is a block diagram showing the circuit construction of another conventional alarm unit.

The control circuit 33 thereafter starts to feed an on signal and an off signal alternately to the transistor T and gives a signal preparation start command to the signal processing circuit 35. The transistor T is brought into conduction in response to the on signal, or brought out of conduction in response to the off signal, whereby the antenna 31 is changed over to alternate between the transmitting operation and the receiving operation as shown in FIG. 7. In response to the signal preparation start command, on the other hand, the signal processing circuit 35 starts to prepare a second notifying signal having a frequency of 5.4 kHz and feed the signal to the outgoing signal amplification circuit 36. The second notifying signal fed to the circuit 36 is thereby amplified and then applied to the antenna 31. The second notifying signal fed to the antenna 31 is sent out as converted to electromagnetic waves by the transmitting operation of the antenna 31.

When the input signal from the incoming signal amplification circuit 32 is found to be the alarm stop signal, the control circuit 33 gives an alarm stop command to the buzzer 34, which in turn ceases producing an alarm. The control circuit 33 further feeds an off signal to the transistor T and gives a signal preparation stop command to the signal processing circuit 35. The transistor T is brought out of conduction in response to the off signal, whereby the antenna 31 is changed over to the receiving operation. In response to the stop command, the signal processing circuit 35 ceases preparing the second notifying signal and feeding the signal to the outgoing signal amplification circuit 36. As a result, the antenna 31 ceases sending out the second notifying signal.

The commodity to be protected against theft by the antitheft system of the present embodiment is placed on a display table with the alarm unit 3 attached to the commodity and with the antenna 31 set in receiving operation.

When the customer is about to unlawfully bring out the alarm unit 3 from the store along with the commodity, the antenna 31 of the alarm unit 3 receives a first notifying signal from the signal generator incorporated in the antitheft gate, and the first notifying signal is fed to the control circuit 33 via the incoming signal amplification circuit 32. As a result, the buzzer 34 starts to produce an alarm.

The antenna 31 is thereafter changed over to alternate between the transmitting operation and the receiving operation, intermittently sending out a second notifying signal.

In response to the second notifying signal intermittently transmitted from the alarm unit 3, the alarm device in the antitheft gate gives an alarm.

When the clerk thereafter manipulates the alarm stopping device to transmit an alarm stop signal to the alarm unit 3 producing the alarm, the antenna 31 alternating between the transmitting operation and the receiving operation as stated above receives the alarm stop signal from the alarm stopping device in the state of receiving operation, and the stop signal is fed to the control circuit 33 via the incoming signal amplification circuit 32. Consequently, the buzzer 34 ceases producing the alarm, and the antenna 31 is changed over to the receiving operation to cease sending out the second notifying signal.

When the transmission of the second notifying signal from the antenna 31 of the alarm unit 3 is discontinued, the alarm device of the antitheft gate ceases producing the alarm.

Since the antenna 31 comprises the single coil L which is used in common for receiving the first notifying signal from the antitheft gate and for transmitting the second notifying signal to the gate, the alarm unit 3 of the present embodiment is compacted and easy to attach to small commodities.

The embodiments described above are intended to illustrate the present invention and should not be construed as limiting the invention set defined in the appended claims or restricting the scope thereof. The system of the present invention is not limited to the foregoing embodiments in construction but can of course be modified variously without departing from the spirit of the invention as set forth in the claims.

For example, although the alarm device 22 is incorporated in the antitheft gate 2 along with the signal generator 21 according to the first embodiment, this construction is not limitative but the alarm device 22 can be enclosed in a casing and installed in the store separately from the gate 2.

Further according to the first embodiment, the second harmonic of the electromagnetic waves generated by the electronic buzzer 11 of the alarm unit 1 is utilized as a signal for driving the alarm producing circuit 225 of the alarm device 22 incorporated in the antitheft gate 2, whereas the fundamental wave of the electromagnetic waves, third harmonic or one of harmonics thereof with greater frequencies can alternatively be utilized. For example in the case where the third harmonic is to be used, the band-pass filter shown in FIG. 3 is replaced by a band-pass filter permitting the passage of a signal having a frequency of 8.1 kHz. It is desirable in this case to use a current having a rectangular waveform with duty of 50% as the current for driving the electronic buzzer 11 of the alarm unit 1. The current used enables the buzzer 11 to produce only nth harmonic (wherein n is an odd number), whereby the third harmonic of increased output is available.

The alarm unit 3 of the second embodiment can be provided with the same alarm actuating switch piece as used in the first embodiment so as to start to produce the alarm and send out the second notifying signal when the switch piece is opened to the off state.

Further according to the second embodiment, the present invention is embodied as an antitheft system wherein the alarm unit 3 starts to give an alarm and transmit a second notifying signal to an antitheft gate in an event of the customer acting wrongfully, whereas this embodiment is not limitative but the invention can be embodied also as a monitoring system comprising an alarm unit which starts to merely transmit the second notifying signal to the gate.

What is claimed is:

1. An antitheft system comprising:

a notifying signal generator for producing a notifying signal, an alarm unit to be attached to an article to be prevented from being stolen and comprising an electronic buzzer, signal receiving means for receiving the notifying signal from the signal generator, and first control means for operating the electronic buzzer upon the signal receiving means receiving the notifying signal, and an alarm device comprising alarm means capable of producing an alarm, electromagnetic wave receiving means for receiving electromagnetic waves generated by the electronic buzzer by operating the electronic buzzer, and second control means for operating the alarm means upon the electromagnetic wave receiving means receiving the electromagnetic waves.

2. An antitheft system according to claim 1 wherein the alarm unit comprises means for detecting detachment of the alarm unit from the article to produce a detection signal, and the first control means operates the electronic buzzer upon receiving the detection signal.

3. An antitheft system according to claim 1 wherein the electromagnetic wave receiving means of the alarm device receives second harmonic of the electromagnetic waves, and the second control means operates the alarm means upon the electromagnetic wave receiving means receiving the second harmonic.

4. An antitheft system comprising:

a notifying signal generator for producing a notifying signal, an electromagnetic wave generator to be attached to an article to be prevented from being stolen and comprising electromagnetic wave generating means capable of generating electromagnetic waves including a harmonic, signal receiving means for receiving the notifying signal from the signal generator, and first control means for operating the electromagnetic wave generating means upon the signal receiving means receiving the notifying signal, and an alarm device comprising alarm means capable of producing an alarm, electromagnetic wave receiving means for receiving the harmonic of the electromagnetic waves generated by the electromagnetic wave generator, and second control means for operating the alarm means upon the electromagnetic wave receiving means receiving the harmonic of the electromagnetic waves.

5. An antitheft system according to claim 4 wherein the electromagnetic wave generator comprises means for detecting detachment of the wave generator from the article to produce a detection signal, and the first control means operates the electromagnetic wave generating means upon receiving the detection signal.

6. An antitheft system comprising:

a notifying signal generator for producing a first notifying signal, an alarm unit to be attached to an article to be prevented from being stolen and operable to produce an alarm and a second notifying signal different from the first notifying signal in frequency upon receiving the first notifying signal from the signal generator, and an alarm device for producing an alarm upon receiving the second notifying signal from the alarm unit, the alarm unit having an antenna for receiving the first notifying signal and transmitting the second notifying signal, the antenna comprising a coil usable in common for receiving the first notifying signal and for transmitting the second notifying signal.

7. An antitheft system comprising:

a notifying signal generator for producing a first notifying signal, an alarm unit to be attached to an article to be prevented from being stolen and operable to produce an alarm and a second notifying signal different from the first notifying signal in frequency upon receiving the first notifying signal from the signal generator, and an alarm device for producing an alarm upon receiving the second notifying signal from the alarm unit, the alarm unit comprising:

alarm means capable of producing an alarm, an antenna for receiving the first notifying signal and transmitting the second notifying signal, alarm control means for operating the alarm means upon the antenna receiving the first notifying signal, signal processing means for preparing the second notifying signal and feeding the second notifying signal to the antenna upon the antenna receiving the first notifying signal, and change-over control means for changing over the antenna from the receiving operation to the transmitting operation and vice versa, the antenna comprising a coil L and a first capacitor C1 and a second capacitor C2 which are connected to the coil L, the change-over control means being operable to change over the antenna from the receiving operation by the coil L and the first capacitor C1 to the transmitting operation by the coil L and the second capacitor C2 and vice versa.

8. An antitheft system according to claim 7 which further comprises a stop signal generator for producing an alarm stop signal for stopping the alarm of the alarm unit and wherein the alarm unit is capable of receiving the alarm stop signal by the antenna and has alarm stopping control means for stopping the operation of the alarm means upon receiving the alarm stop signal from the stop signal generator, and the change-over control means causes the antenna to alternate between the receiving operation and the transmitting operation after the alarm means is initiated into operation.

9. An antitheft system according to claim 7 wherein the coil L has one end P having connected thereto one end of the first capacitor C1 and an input end of the alarm control means, the other end of the first capacitor C1 being grounded, the other end of the coil L having one end of the second capacitor C2 connected thereto, the other end of the second capacitor C2 having an output end of the signal processing means connected thereto, the change-over control means comprising a transistor capable of grounding said one end P of the coil L, the second capacitor C2 being greater than the first capacitor C1 in capacity.

10. A monitoring system comprising:

a first notifying signal generator for producing a first notifying signal, a second notifying signal generator for producing a second notifying signal different from the first notifying signal in frequency upon receiving the first notifying signal from the first notifying signal generator, and an alarm device for producing an alarm upon receiving the second notifying signal from the second notifying signal generator, the second notifying signal generator comprising:

an antenna for receiving the first notifying signal and for transmitting the second notifying signal, signal processing means for preparing the second notifying signal and feeding the second notifying signal to the antenna upon the antenna receiving the first notifying signal, and change-over control means for changing over the antenna from a receiving operation to a transmitting operation, and vice versa, the antenna comprising a coil, and a first capacitor C1 and a second capacitor C2 which are connected to the coil, the change-over control means being operable to change over the antenna from the receiving operation by the coil and the first capacitor to the transmitting operation by the coil and the second capacitor, and vice versa.

11. A monitoring system according to claim 10 wherein a first end of the coil being connected to a first end of the first capacitor and an input end of the change-over control means, a second end of the first capacitor being grounded, a second end of the coil being connected to a first end of the second capacitor, and a second end of the second capacitor being connected to an output end of the signal processing means, the change-over control means comprising a transistor capable of grounding the first end of the coil, the second capacitor having a capacity greater than a capacity of the first capacitor.

* * * * *